US006578298B2

(12) United States Patent
Stankiewicz

(10) Patent No.: US 6,578,298 B2
(45) Date of Patent: Jun. 17, 2003

(54) SMALL PIECE FEED BASKET ASSEMBLY

(75) Inventor: Stanley Stankiewicz, Middle Village, NY (US)

(73) Assignee: Mesh Management Company, LLC, New York, NY (US)

( * ) Notice: Subject to any disclaimer, the term of this patent is extended or adjusted under 35 U.S.C. 154(b) by 0 days.

(21) Appl. No.: 09/989,553

(22) Filed: Nov. 20, 2001

(65) Prior Publication Data

US 2003/0093930 A1 May 22, 2003

(51) Int. Cl.[7] ..... D06F 67/04
(52) U.S. Cl. ..... 38/143
(58) Field of Search ..... 38/106, 111, 143, 38/141; 222/92, 180; 312/27, 28, 29, 211, 249.7, 319.5, 319.6, 319.8, 325, 330.1, 334.1, 334.8, 334.13, 349; 108/6, 20, 25, 35

(56) References Cited

U.S. PATENT DOCUMENTS 1,836,938 A * 12/1931 Sager ..... 38/143
2,633,650 A * 4/1953 Blumenshien ..... 38/111
2,637,918 A * 5/1953 Mayhew ..... 108/26
3,664,046 A * 5/1972 Thompson ..... 198/570
5,168,645 A * 12/1992 Robin et al. ..... 198/465.4

* cited by examiner

*Primary Examiner*—Ismael Izaguirre
(74) *Attorney, Agent, or Firm*—Fish & Richardson P.C.

(57) ABSTRACT

A feed basket assembly is mounted to the loading end of commercial laundry spreader/feeder machine to facilitate the feeding of small articles such as pillowcases and napkins. The assembly includes a feed basket, a drawer slide, slide brackets for mounting the drawer slide to the spreader/feeder machine and means for moving the assembly from a stored position to an operational position and back. When not in use, the feed basket is stored in a first position, beneath the main feed of the commercial laundry machine, out of the way of the machine's operator. In use, the feed basket may be situated in a second position, contiguous with the main feed of the commercial laundry machine.

6 Claims, 4 Drawing Sheets

SMALL PIECE FEED BASKET ASSEMBLY

TECHNICAL FIELD

This invention relates generally to commercial laundry machines and, more particularly, to a device for feeding small pieces of laundry such as napkins and pillowcases into a commercial laundry machine.

BACKGROUND

Commercial laundry facilities servicing hotels, restaurants, hospitals and the like are required to wash, dry and fold large volumes of articles such as bed linen, towels, tablecloths and napkins. After such articles are washed and dried by industrial-grade equipment, they are pressed by a flatwork ironer and subsequently processed by an automatic folder which folds the laundry into a neat package for easy storage and transportation. Such laundry facilities typically use an automatic spreader/feeder machine to allow more rapid and accurate feeding of the sheets into the ironer and folder machinery, thereby increasing efficiency and the quality of the finished product.

At the rear or exit end of the spreader/feeder machine, a continuously moving belt conveyer feeds the laundered articles directly into the pressing and folding equipment, properly oriented for processing. The operator need only load the garments into the forward or entry end of the spreader/feeder machine.

Depending upon the size and shape of the articles of laundry being loaded by the operator, the spreader/feeder machine assumes one of two configurations. When large articles such as bed sheets, blankets and tablecloths are to be loaded, the operator places an edge of the item directly into a large piece clamp mounted on a pivot arm which releasably grips the item of laundry. The pivot arm is movable between a forwardly extending first position in which the edge of the item of laundry is gripped and a second position closer to the rear of the spreader/feeder machine than the first position. The large item of laundry is then fed into the spreader/feeder machine. A spreader mechanism is provided for spreading apart the top corners of the large article. After processing, the large item of laundry is deposited onto the rear conveyor table where it is transported to a subsequent piece of machinery such as an ironer/folder for processing. This process is repeated until all of the laundered articles have been processed. The details of this structure are not part of the present invention. Consequently, they are not disclosed here.

Alternatively, when the operator is processing small laundry articles such as towels, pillowcases and napkins, the large piece clamp and pivot arm are no longer used. Instead, a second conveyor table, mounted on the entry end of the spreader/feeder machine, is raised, via pneumatic cylinders, into a position between the machine and its operator. When not in use, the forward conveyor table is stored within the spreader/feeder machine. When raised, the small articles of laundry are placed flat directly onto the conveyor of the forward table which moves the articles into the spreader/feeder machine and ultimately to the ironer, folder or other processing equipment. Again, the details of this structure are not part of the present invention and are not disclosed here.

Spreader/feeder machines of this general type are known in the prior art.

After the articles are washed and dried, the typical practice in commercial laundry facilities is to place the articles in large laundry bins and wheel or otherwise transport them to the spreader/feeder machine. An operator stands next to the laundry bin, removes the articles by hand and feeds them into the spreader/feeder machine for subsequent transport to the ironer and folder. When feeding large laundry articles into the spreader/feeder machine, the operator positions the laundry bin in the area between the operator and the spreader/feeder machine. The operator simply picks up the next article of laundry and places its edge into the large piece clamp described above. The operator continues in this manner until the bin is empty. At that point, the empty laundry bin is removed and a full laundry bin is put in its place.

While this process works well, it is inefficient for smaller articles of laundry such as pillowcases and napkins when the forward conveyor table is employed. This is because the forward conveyor table occupies the area between the operator and the spreader/feeder machine. Consequently, the laundry bin must be located behind the operator, causing the operator to constantly turn away from the spreader/feeder machine in order to retrieve another article and load it into the spreader/feeder. This problem is exacerbated by the fact that there is a greater number of individual items in the bins containing the small articles of laundry relative to a bin containing large articles. Consequently, the operator is required to turn away from the spreader/feeder machine numerous times thereby causing the operator to undergo repeated unnatural twisting and bending movements.

SUMMARY

Presented is a feed basket that attaches to the forward conveyor table of a commercial spreader/feeder machine. When the forward conveyor table is raised to its extended and operational position, the feed basket assembly extends outwardly from the forward conveyor table and is positioned between the forward conveyor table and the spreader/feeder machine's operator. This allows the operator to place small items such as napkins, towels and pillowcases into the small piece feed basket after they have been washed and dried by separate machinery. The operator can remove each article of laundry from the conveniently placed small piece feed basket and place it on the feeder/dryer machine's forward conveyer table without having to turn around and reach into a separate laundry bin. An extension is added to the forward conveyor table to accommodate a doffer roll that secures the small article to the table and allows the operator to place the small items directly onto the table without having to reach across the small piece feed basket assembly that now occupies the space between the operator and the spreader/feeder machine.

When not in use, the small piece feed basket assembly folds behind and beneath the forward conveyor table so as not to interfere with the operation of the spreader/feeder machine. The small piece feed basket is mounted on two sets of heavy-duty drawer slides that are attached to opposite sides of the forward conveyor table. In an implementation, the small piece feed basket assembly is pneumatically operated so that when the operator depresses a control switch, the feed basket is lowered below the level of the forward conveyor table and withdrawn into the void beneath the forward conveyor table and in front of the spreader/feeder machine. When placed in this position, the small piece feed basket is removed from view and the spreader/feeder machine operates as it did before the implementation of the small piece feed basket. When the small piece feed basket is to be placed into use, a control switch is depressed and the pneumatic cylinders move the feed basket into its operational position.

Accordingly, the present invention provides a small piece feed basket assembly that is capable of being positioned contiguous with the forward conveyor table of a commercial spreader/feeder machine for retaining small laundry articles.

The present invention also provides means for storing the small piece feed basket when it is not in use by the operator so that it does not interfere with the other functions of the spreader/feeder machine.

Further, the present invention also mounts the small piece feed basket to the feed table via pneumatic cylinders which permit the small piece feed basket to move automatically between its operational and stored positions upon switch activation.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
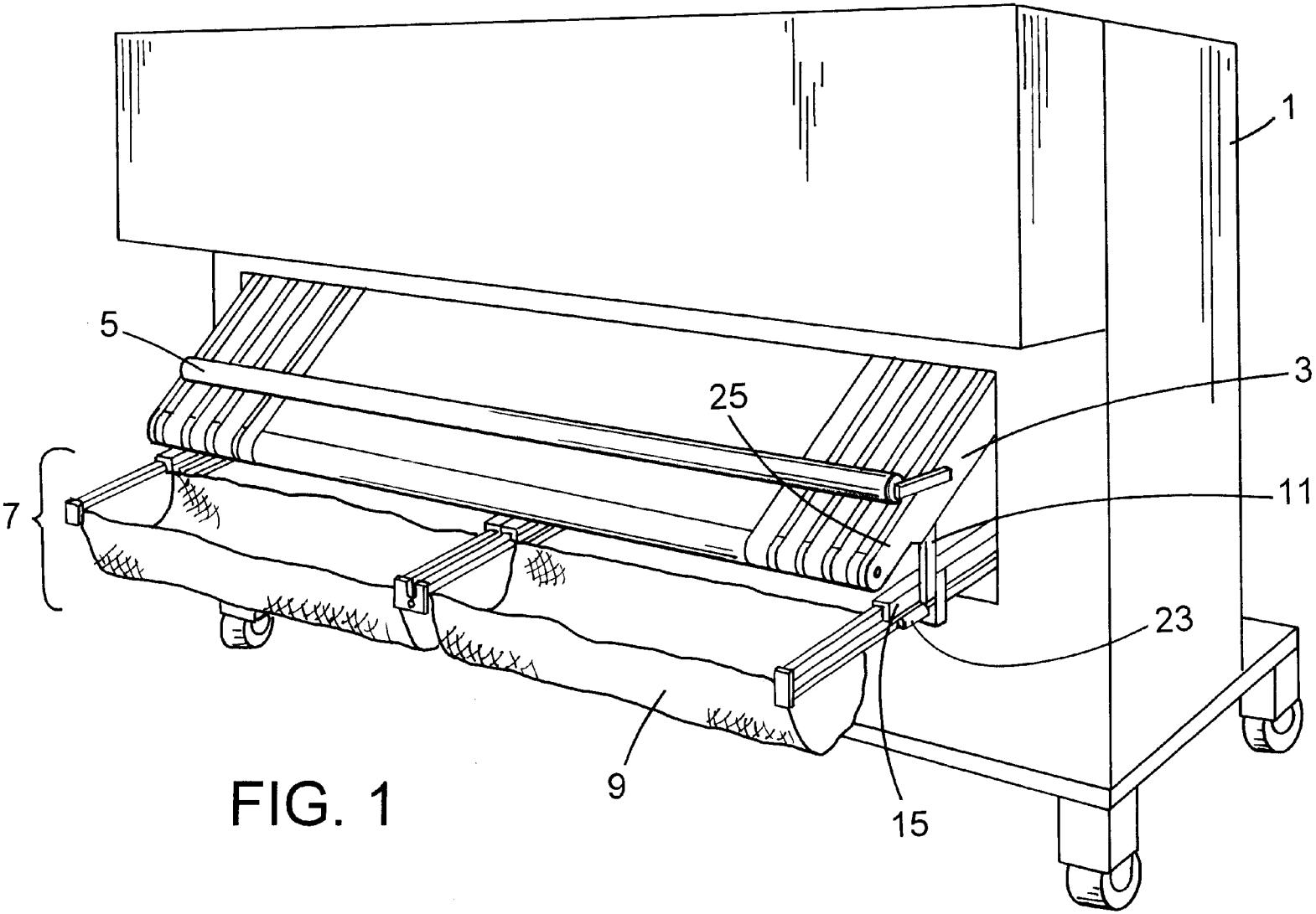
FIG. 1 is a perspective view of a spreader/feeder machine with a small piece feed basket according to the invention.

Referring to the figures, FIG. 1 shows an embodiment of the spreader/feeder machine with the small piece feed basket assembly in the extended and operational position. The spreader/feeder machine 1 has a forward conveyor table 3, a doffer roll 5 and small piece feed basket assembly indicated generally at 7.

Figure 3:
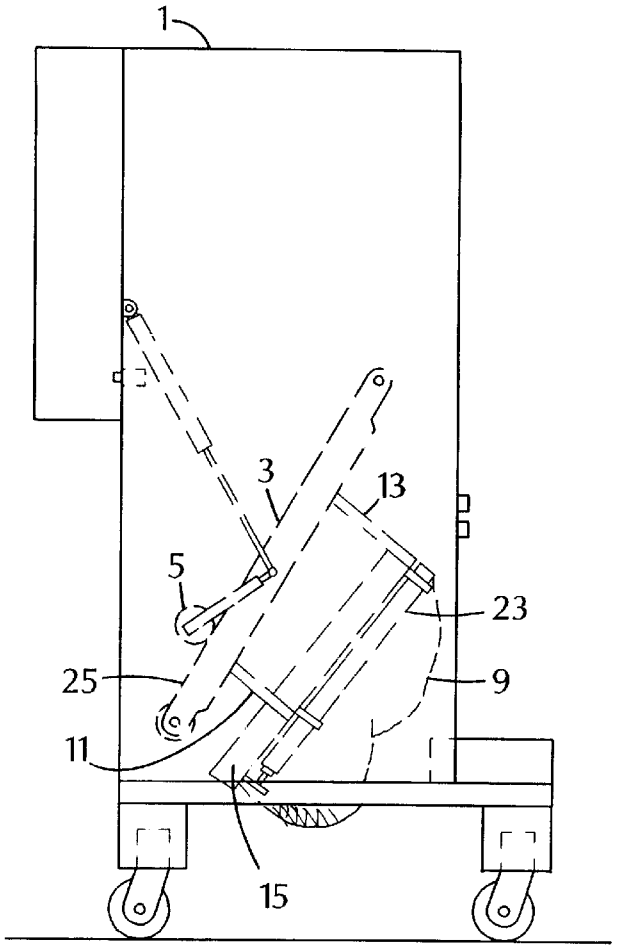
FIG. 3 is a side view of a spreader/feeder machine with the small piece feed basket assembly, according to the invention, in its stored position.
Figure 2:
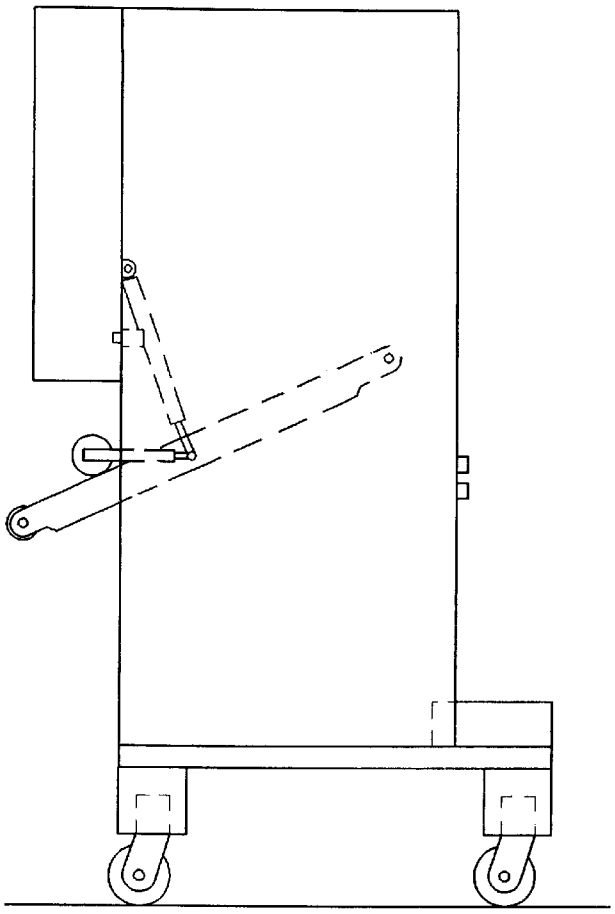
PRIOR ART FIG. 2
FIG. 2 is a side view of a prior art spreader/feeder machine adapted for use with large articles of laundry.
Figure 4:
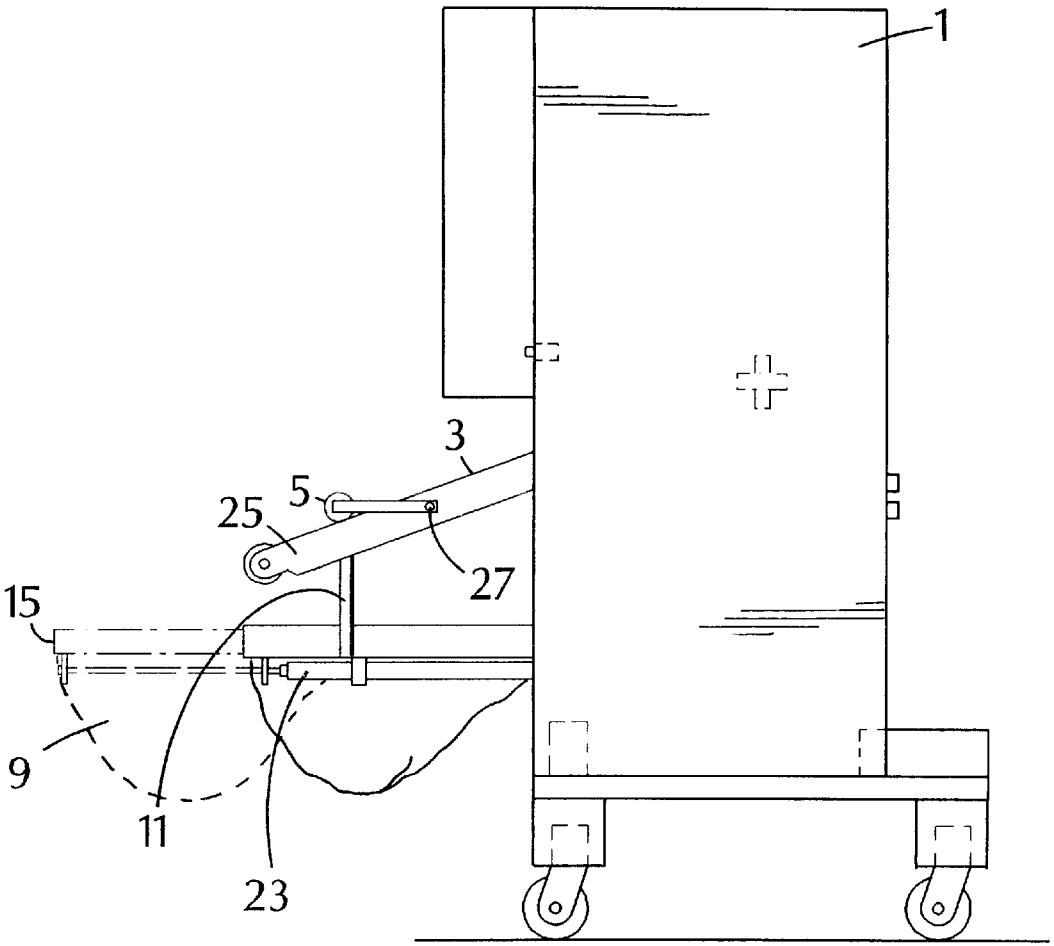
FIG. 4 shows the spreader/feeder machine of FIG. 3 with the small piece feed basket assembly in its extended and operational position.

FIG. 3 illustrates the spreader/feeder machine 1 configured with the small piece feed basket assembly 7 in its stored position. This is the configuration of the machine when it is adapted to receive large articles of laundry.

Generally, the feed basket assembly 7 comprises a feed basket 9, forward and rear slide brackets 11 and 13 and drawer slide 15. The slide brackets 11 and 13 join the drawer slide 15 to the forward conveyor table 3. This embodiment, the feed basket 9 is fabricated from vinyl or similar material that is impermeable to moisture, thereby making it resistant to mildew. In practice, however, the feed basket can be fabricated from any material suitable to form a receptacle.

The feed basket assembly 7 is mounted to the forward conveyor table 3 through the forward slide brackets 11 and rear slide brackets 13. In this embodiment, three forward and three rear slide brackets are used. The slide brackets are fabricated from square tubing, 1¼"×1¼" in cross section. The forward slide brackets 11 are each 10" in length and the rear slide brackets 13 are each 15" in length. Because the forward conveyor table slopes downward toward the operator, the forward slide brackets are shorter than the rear slide brackets in order to keep the feed basket assembly level. The upper ends of the forward 11 and rear 13 slide brackets are mounted to the underside of the forward conveyor table 3. The lower ends of the forward 11 and rear 13 slide brackets are mounted to the upper side of slide drawer 15. In this embodiment, the slide brackets are welded to the underside of the forward conveyor table 3 and the upper side of drawer slide 15. However, bolts or any other fastening means may be used to attach the slide brackets to the forward conveyor table and drawer slide.

Figure 5:
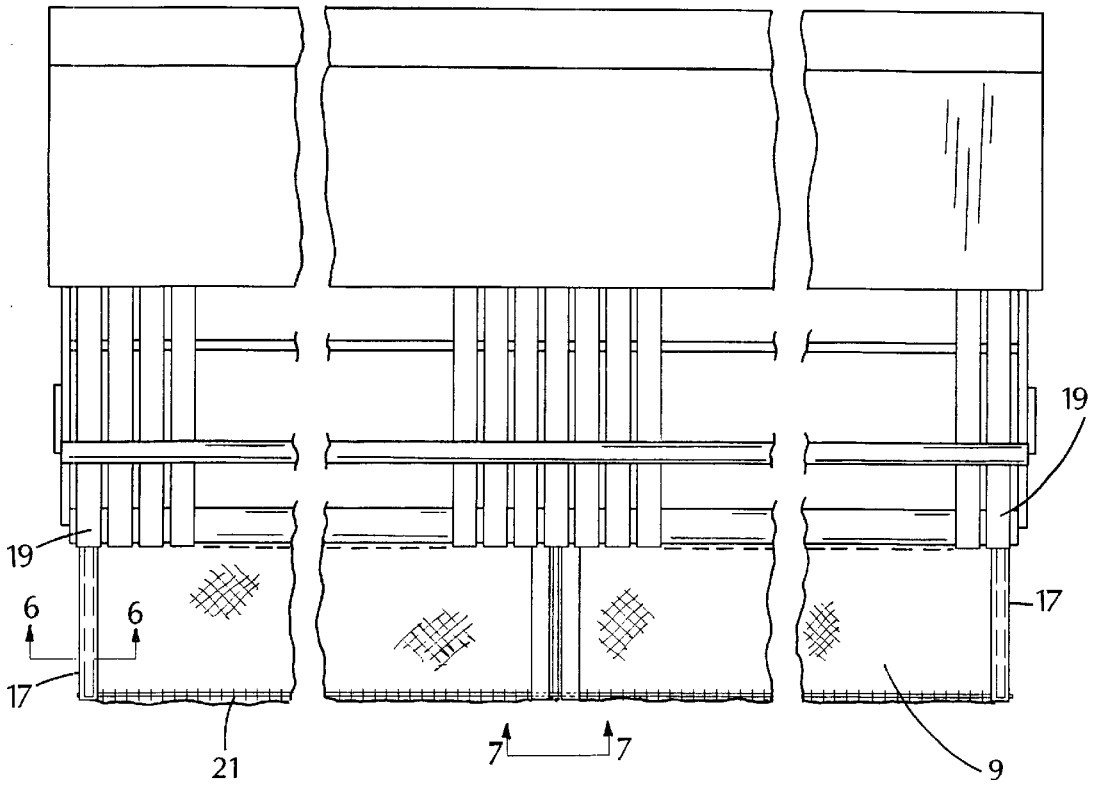
FIG. 5 is an elevation view of an implementation of a small piece feed basket assembly according to the invention.
Figure 6:
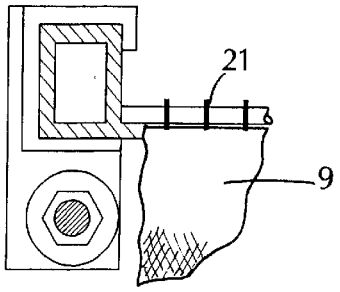
FIG. 6 is a cross-sectional view of the draw slide viewed in the direction of line 6—6 of FIG. 5.
Figure 7:
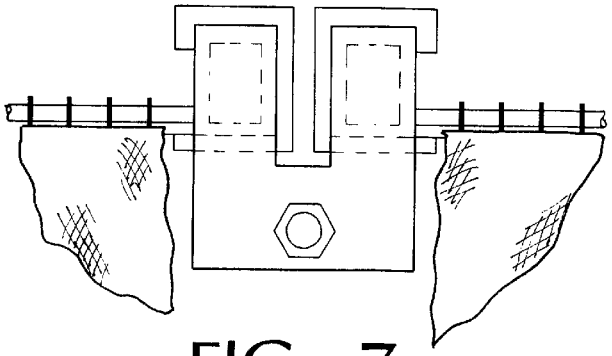
FIG. 7 is a cross-sectional view of the draw slide viewed in the direction of line 7—7 of FIG. 5.

The drawer slide 15 support and form the perimeter of the feed basket 9 as depicted in FIG. 5. Drawer slides of the type used to form the feed-basket assembly are well known in the art. The drawer slides comprise an inner frame 17 and outer frame 19 attached to one another through ball bearings, rollers, or some similar mechanism which allows one to slide relative to the other. In an embodiment, the lower ends of the forward 11 and rear 13 slide brackets are attached to the outer frame 19 of the drawer-slides slides 15 thereby maintaining it fixed relative to the forward conveyor table 3. When the small piece feed basket assembly is deployed, the inner frame 17 slides outward of the forward conveyor table 3, thereby placing the feed basket 9 in position for operation.

The outer edges of the feed basket 9 are attached to inner frame 17 of the drawer slide 15. The feed basket 9 hangs freely from the drawer slide 15 creating the area into which the small articles of laundry are deposited. In this embodiment, the feed basket 9 has a series of loops 21 along its perimeter as shown in FIG. 5. The sides of the inner frame 17 are threaded through the loops in order to support the feed basket 9.

Given the sliding relationship between the inner frame 17 and outer frame 19, the feed basket 9 can be extended from its lowered, stored position to the raised, active position through application of a force. In practice, the operator need only manually pull the inner frame 17 towards him or her to expose the feed basket 9. In this embodiment, however, the feed basket 9 is extended to its raised position through use of pneumatic cylinders 23. The pneumatic cylinders 23 cylinders comprise a piston mounted within a tube. The tube remains fixed and the piston is driven into and out from the tube through pneumatic means. Pneumatic cylinders of this type are well known in the art and the present invention in not limited to a particular design of pneumatic cylinders.

In this implementation, the tube portion of the pneumatic cylinder 23 is fixed to the outer frame 19 of the drawer slide 15 and the piston is fixed to the inner frame 17 of the drawer slide 15. Upon activation of the pneumatic cylinder 23, the inner frame 17 is driven outwardly relative to the outer frame 19 thereby exposing the feed basket 9. To lower the feed basket, the pneumatic cylinder 23 is activated and the piston withdraws into the tube.

To facilitate use of the feed basket 9 and the placement of small articles of laundry onto the forward conveyor table 3, a doffer roll 5 is mounted on the forward conveyor table 3. The doffer roll 5 serves to hold down the small articles as they are placed onto the forward conveyor table 3 and fed into the spreader/feeder machine 1. This ensures that the small articles of laundry lay flat before they are processed by the spreader/feeder machine 1. To accommodate the doffer roll 5, a table extension 25 is added to the leading edge of the forward conveyor table 3. In addition to holding the doffer roll 5, the table extension 25 allows the operator to more comfortably place the items of laundry onto the forward conveyor table 3 which is now located at a greater distance away from him or her due to the presence of the small piece feed basket assembly 7. In this implementation, the table extension 25 protrudes out from the forward conveyor table 3 a distance of 6-inches.

In an embodiment, the doffer roll 5 is 3-inches in diameter and is fabricated from rubber and canvas. The doffer roll 5 rests upon a 5-inch c-channel bracket 27 mounted on the forward conveyor table 3.

A number of embodiments of the invention have been described. Nevertheless, it will be understood that various modifications of these embodiments may be made without departing from the spirit and scope of the invention. Accordingly, any other embodiments of the invention which are within the scope of the following claims are intended to be within the scope of the patent granted on this invention.

What is claimed is:

1. A small piece feed basket assembly comprising:

a drawer slide for attachment to a commercial spreader/feeder machine, the drawer slide having an inner frame and an outer frame, the inner frame is slidably connected to the outer frame;

a feed basket attached to the drawer slide wherein the drawer slide is attached to the commercial spreader/feeder machine through at least one slide bracket; and at least one forward and at least one rear slide bracket.

2. A small piece feed basket assembly comprising:

a drawer slide for attachment to a commercial spreader/feeder machine, the drawer slide having an inner frame and an outer frame, the inner frame is slidably connected to the outer frame;

a feed basket attached to the drawer slide; and pneumatic cylinder means for sliding the inner frame relative to the outer frame.

3. A small piece feed basket assembly comprising:

a drawer slide for attachment to a commercial spreader/feeder machine, the drawer slide having an inner frame and an outer frame, the inner frame is slidably connected to the outer frame;

a feed basket attached to the drawer slide; and a doffer roll mounted on the spreader/feeder machine.

4. A small piece feed basket assembly comprising:

a drawer slide for attachment to a feed table of a commercial spreader/feeder machine, the drawer slide having an inner frame and an outer frame, wherein the inner frame is slidably connected to the outer frame; and a feed basket attached to the drawer slide; and pneumatic cylinder means for sliding the inner frame relative to the outer frame.

5. A small piece feed basket assembly comprising:

a drawer slide for attachment to a feed table of a commercial spreader/feeder machine, the drawer slide having an inner frame and an outer frame, wherein the inner frame is slidably connected to the outer frame;

a feed basket attached to the drawer slide; and a doffer roll mounted on the feed table.

6. A small piece feed basket assembly comprising:

a drawer slide for attachment to a feed table of a commercial spreader/feeder machine, the drawer slide having an inner frame and an outer frame, wherein the inner frame is slidably connected to the outer frame;

a feed basket attached to the drawer slide; and a feed table extension mounted on the feed table.

* * * * *